United States Patent [19]

Eigenmann

[11] Patent Number: 4,685,824

[45] Date of Patent: Aug. 11, 1987

[54] ROAD MARKING PROVIDED WITH PROTRUDING ELEMENTS CAPABLE OF RESISTING TO SNOW PLOWING IMPLEMENTS

[76] Inventor: Ludwig Eigenmann, POB 114, CH 6833 Vacallo, Switzerland

[21] Appl. No.: 763,421

[22] Filed: Aug. 7, 1985

Related U.S. Application Data

[63] Continuation of Ser. No. 513,983, Jul. 14, 1983, abandoned.

[30] Foreign Application Priority Data

Jul. 27, 1982 [IT] Italy ..... 22584 A/82
May 30, 1983 [IT] Italy ..... 213355 A/83

[51] Int. Cl.[4] ..... E01F 9/04

[52] U.S. Cl. ..... 404/9; 404/12; 404/14

[58] Field of Search ..... 404/11, 12, 14, 15, 404/16, 9; 428/17, 141, 143, 147

[56] References Cited

U.S. PATENT DOCUMENTS 2,225,496 12/1940 Gethin et al. ..... 404/12
3,920,348 11/1975 Paulos ..... 404/11 X
4,117,192 9/1978 Jorgensen ..... 404/93 X
4,123,140 10/1978 Ryan et al. ..... 404/12 X
4,129,673 12/1978 Eigenmann ..... 404/9 X
4,146,635 3/1979 Eigenmann ..... 404/12 X
4,218,059 8/1980 Eiden ..... 404/11 X
4,300,973 11/1981 Bezwada ..... 428/462 X

*Primary Examiner*—James A. Leppink
*Assistant Examiner*—Matthew Smith
*Attorney, Agent, or Firm*—Michael J. Striker

[57] ABSTRACT

The invention deals with a road marking tape which has retroreflective elements and protruding anti-skid elements, and which means is provided for preventing damaging of the retroreflective elements by snow plowing means. The preventing means is designed in accordance with the present invention in a special manner as a compressible element which is composed of a compressible material so that in response to impact of the protruding elements of the tape by the snow plowing means the compressible material of the compressible element compresses and the original thickness of the compressible material reduces to a predetermined thickness which is selected so that the protruding element sink into the groove by the depth at least equal to the height of the protruding elements.

7 Claims, 7 Drawing Figures

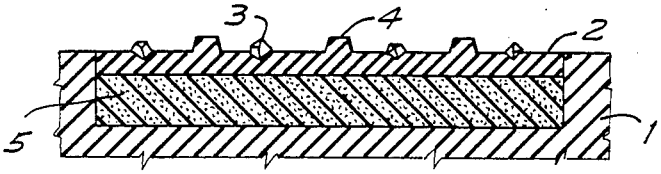
Fig. 1
Fig. 2
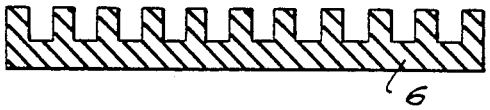
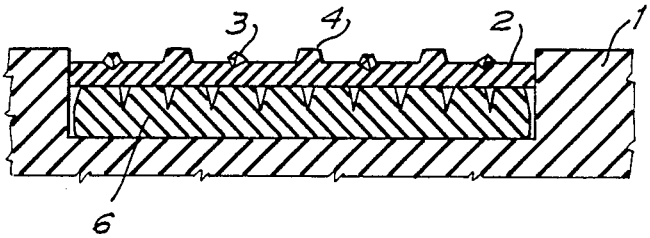
Fig. 3
Fig. 4
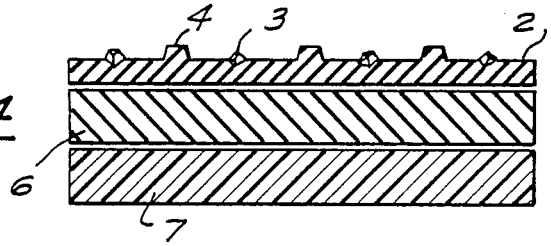
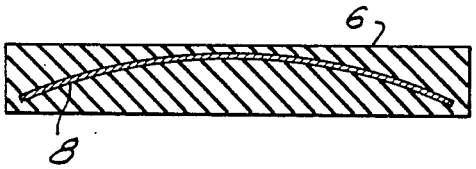
Fig. 5
Fig. 6
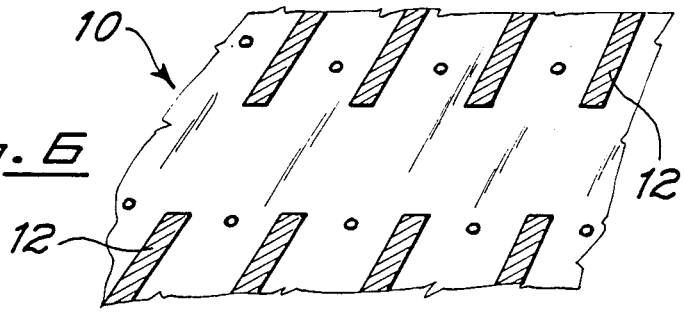

ROAD MARKING PROVIDED WITH PROTRUDING ELEMENTS CAPABLE OF RESISTING TO SNOW PLOWING IMPLEMENTS

This is a continuation of application Ser. No. 513,983, filed July 14, 1983, now abandoned.

BACKGROUND OF THE INVENTION

The present invention concerns a road marking strip capable of resisting to the passage of snow plowing implements and the like provided with snow blades sliding on the road surface. The present invention also concerns an improvement in methods of laying the road marking strip and improved apparatus for laying the road marking strip on road surfaces which are generally but not critically bituminous. More particularly, the present invention deals with laying of the road marking strip in situ in rows with progressive pressing of the tape on the road surface.

The art of road signalization has undergone in the last few decades a great development corresponding to the development of the motorization. This art, together with means, devices and apparatuses for laying down road marking elements is characterized by several improvements including the developments of the applicant who has tested and manufactured many road marking materials and apparatuses. These developments are reflected in technical and scientific publications as well as in numerous patents of the applicant. Among the problems which have been considered and partly solved by the applicant are the problems which are related to road markings to be used in winter time and/or in Northern zones, which must resist snow plowing and keep their visibility at night. It is known in the prior art that the problem of visibility of the road marking at night, in the rain and in general under unfavorable weather conditions cannot be considered as solved, especially on main road ways, not withstanding the amount of money which has been spent for the solution of this problem. Removal of snow is performed in general by snow plowing machines provided usually with blades made of metal or metallic carbures and the like capable of resisting to wearing out caused by sliding above the road pavement. It is well known that in especially severe weather conditions the combination of lower temperature and abundant snow leads to the formation on the road surface of ice which becomes particularly compact and slowly soluble, resisting even to salt solutions. Its high crystallization makes necessary the use of metal or metallic carbures blades. However, the blades remove and practically destroy the optical elements provided for imparting to the road surface of a good visibility in the rain at night.

The applicant has conducted studies and experiments for improving the existing systems and means designed to operate under the action of snow blowing means. In the applicant's U.S. Pat. No. 4,129,673 it has been proposed to provide a prefabricated road marking strip protected from the destructive action of snow blowing means by protruding components acting as rails which jointly define a plane for sliding of the blades above the protruding elements. This solution has been proved to be particularly efficient in protecting the optical elements against the action of rubber blades and at low speed in the town use, as well as against the action of metal blades. However, the most important problem connected to the high speed traffic roads where the blades of snow blowing means are caused to slide at high speed remains practically not solved.

Applicant has also proposed road marking means provided with retroflective elements which can be lowered "as a flag", as disclosed for example in the U.S. Pat. No. 3,879,148.

SUMMARY OF THE INVENTION

The present invention solves the problem of insuring the visibility of a road marking under rain at night and good adherence of tires on high speed traffic road surface by removing of compact ice.

According to the present invention a prefabricated marking tape can in operation at least partially sink under compression, under the level of the road pavement. A compressable portion of the marking tape forms a part of the same and is preferably associated with a meltable bituminous primer if applied on the same road pavement. All marking tapes provided with optical elements as proposed by the applicant are suitable of being protected from the action of snow plowing blades according to the present invention.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a view showing a road marking arranged in a road pavement, in accordance with the present invention;

FIG. 2 is a view showing a part of the inventive road marking accordance with another embodiment of the invention;

FIG. 3 is a view showing the inventive road marking in a compressed condition;

FIG. 4 is a view showing a prefabricated road marking to be laid on a road pavement;

FIG. 5 is a view showing a part of the inventive road marking in accordance with a further embodiment of the invention;

FIG. 6 is a plane view of a road pavement provided with the road marking in accordance with the present invention.

DESCRIPTION OF PREFERRED EMBODIMENTS

Figure 7:
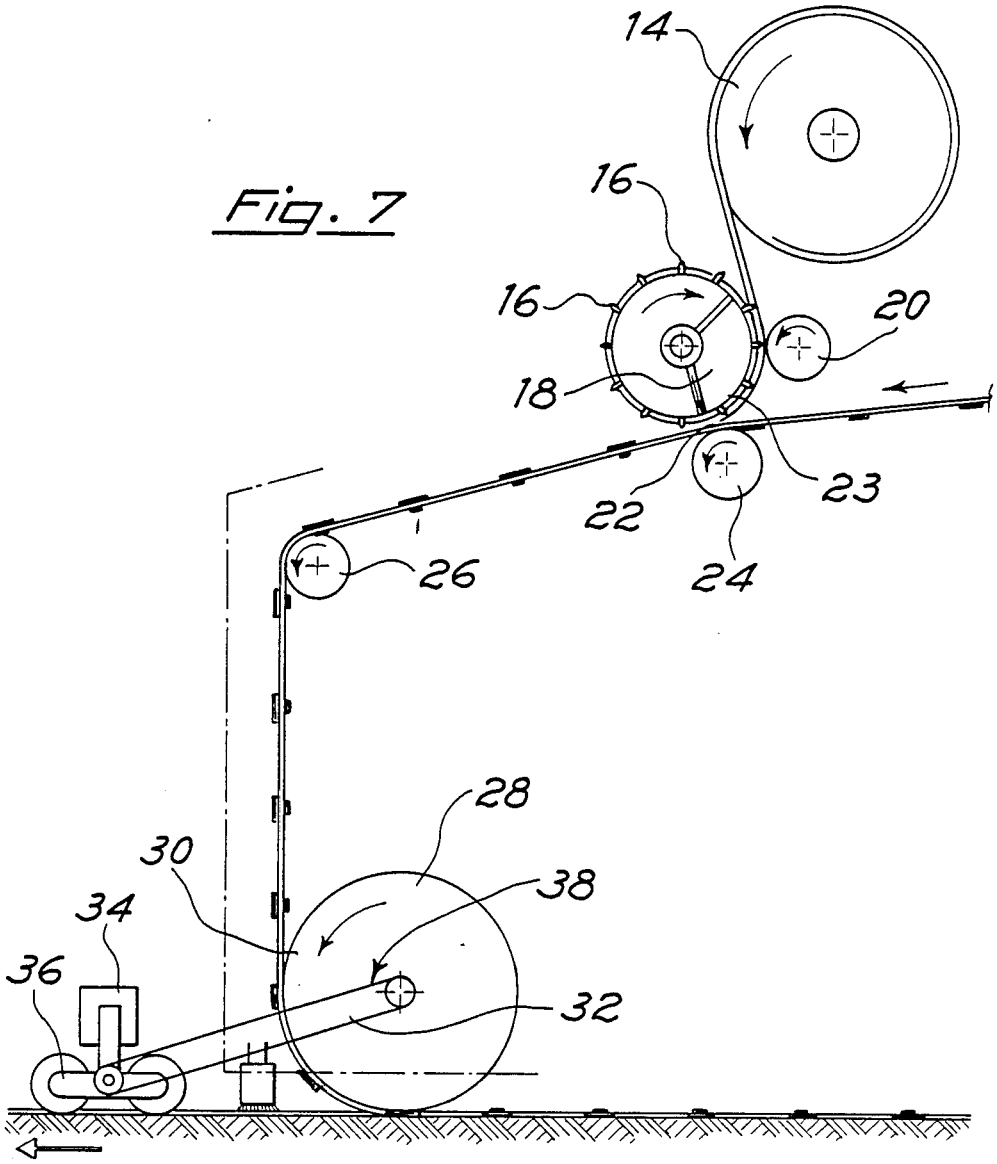
FIG. 7 is a view showing an apparatus for laying the inventive road marking.

As can be seen from FIG. 1, a road marking in accordance with the present invention is a composite structure which has an element 5 deformable under compression, for example formed of expansible terpolymer rubber in which the elastomeric material is associated with a gas, practically air. The upper portion of the road marking is a marking tape 2 provided with rails 4 and retroreflective globules 3.

FIG. 2 shows another embodiment in accordance with which a deformable element 6 is composed of an elastomer which does not have internal hollows. In this deformable element 6 the space for compensating the volume shrinking is formed in the upper portion of the element.

As can be seen from FIG. 3 the road marking under compression is deformed so that the upper surface of it is located below the road pavement level, while the upper surface of the rails is located at the road pavement level.

The road marking of the invention is a prefabricated tape which is shown in its unity in FIG. 4 and has the upper part serving as a marking 2, the deformable element 6 located under the upper part, and a meltable bituminous element 7 located under the deformable element 6 and filling the grooves in the road pavement 1 during laying of the inventive road marking.

The deformable element 6 can be provided with a metallic element (8) of harmonic steel. This embodiment is shown in FIG. 5.

FIG. 6 illustrates the inventive road marking applied to the road pavement. The rails are identified with reference numeral 12 and the road marking formed as a prefabricated tape is identified as a whole with reference numeral 10. This example shows a plurality of the rails 12, however there can be just one rail on the inventive road marking.

The road marking is formed as road marking tape of small thickness, for example as disclosed in the applicant's Pat. No. 4,146,635, the disclosure of which is completely incorporated in this application.

The deformable element which is formed of an elastomer associated with metallic elements of harmonic steel or without the latter has the function of ensuring, upon deformation, the return to the original configuration. This deformable element is known per se in the art. The deformable element capable of resisting to a great number of repeating compressions and to the attack of atmospheric agents can be composed either of an elastomer without internal hollows and with external hollows on its upper face for compensating its volume shrinking, or also can be composed of a microcellular elastomeric foam.

Elastomer resisting to hydrolysis and to atmospheric agents are principally terpolymer rubbers, like the Dutral Montecatini, Vistalon Esso, or butyl rubbers like Polisar butyl of Polisar Company. Other elastomeres can also be taken into consideration. The foam materials are at best produced with closed cells, vulcanized and have high density for ensuring high portance and maximum flex life. Since the compressions are performed in very short times, practically the losses of return do not exist. Foam materials of this type are manufactured as extruding foam rubber by many manufacturers, for example by SAIAG of Cirie [Turin].

The impact of snow plowing blades acts on the protruding components of the prefabricated tape formed as rails, for example as in the U.S. Pat. No. 4,129,673. The rails can preferably be directly produced during the process of production of the tape, for example by means of extruded thermoplastic polyurethane coupled to the road marking film of the tape.

As shown in FIGS. 1 and 3, the road pavement is provided with a groove of suitable widths and depths. The bituminous binder or meltable bituminous compound possessing mechanical properties which are higher than those of the road pavement is laid in the grooves. The bituminous binder is described, for example, in the U.S. Pat. No. 4,102,718. The deformable element is placed in the melted bituminous binder, and then the marking or signaling tape is laid above the deformable element. According to a modified embodiment of the invention, coupling of the deformable element with the prefabricated tape is provided.

FIG. 7 illustrates the method and the apparatus for laying the road marking in accordance with the present invention. The compressible elastomatic material in the shape in which is stored is held on a bobbin 14. The marking tape 40 is supplied from another bobbin. A set of cutting blades 16 has a pitch which corresponds to the width of the material to be coupled. Preferably, but not critically the blades protrude about 1.5 mm from a roller 18 which is actuated so as to rotate step by step in the direction indicated by the arrow. Each of the steps of rotation of the roller 18 corresponds to the pitch between one road marking element and a following one road marking element. Reference numeral 20 identifies a counter roller, reference numeral 22 diagramatically shows an area in which a blow is emitted for exerting the corresponding expelling action, and reference numeral 23 indicates the cutting zone under vacuum. The material to be coupled is advanced toward the ground, for example passing above a coupling roller 24 which couples the cuts of the elastomeric material with the marking tape and then around at least one guiding roller 26 which directs the material downwards. A laying roller is identified with reference 28 and located immediately upstream of a known means 30 emitting a spray of bitumen or an equivalent compound compatible with the road pavement. The laying roller 28 is rotatably located between arms 32 which extend forwardly in direction of motion of the apparatus on the ground and which are subjected to one or more ballast weights 34 of a guiding device 36. The guiding device is advantageously provided with two wheels and is of a compensator type, for example pivoted on a forward extension 38 of the arms 32.

Recent and careful experimentation of the applicant has ascertained that the cost related to the deformable element is not proportional to the cost of the principal component or the tape of the road marking, and the ability of elastic return of the compressably elastomeric component is seriously prejudiced by the storage of the rolls. Consequently, the use of the deformable element is reduced to the portion of the tape which carries the retroreflective elements and the application of the compressable sections on the tape in the same laying operation.

It has also been ascertained that for the purpose of better accommodation of the rear surface of the tape on the road surface, it is convenient that both the groove on the road surface and the deformable element are narrower than the widths of the marking tape.

I claim:

1. A road marking tape capable of resisting the impact of snow plowing implements and similar apparatuses sliding above a road surface and insertable into a groove provided on the road surface, the road marking tape comprising an upper marking tape part having a width and a length and provided with a plurality of retroreflecting elements for ensuring the visibility of the tape in night time and a plurality of protruding elements acting as a rail and having a height at least equal to that of said retro-reflective elements, said protruding elements being formed so as to resist the impact of snow plowing means of snow plowing implements and the like; and means for preventing damaging said retroflecting elements by the snow plowing means by allowing said protruding elements under the impact of the snow plowing means to sink into the groove by a depth at least equal to the height of said rails so that they are located at least at a road pavement level and therefore said retroreflective elements are not damaged by the snow plowing means, said damaging preventing means being formed as a single compressible element located under said upper marking tape part with said retroreflective elements and said protruding elements, said compressible element being coextensive with said upper marking tape part and having a width and a length substantially corresponding to those of the latter, said compressible element being composed of a compressible material which is compressible in any point in response to impact of said protruding elements by the snow plowing means in respective point so that under the action of the compression said compressible material of said compressible element is compressed in the respective point and said compressible elements changes its thickness in the respective point from its original thickness to such a thickness that said protruding elements in the respective point sink into the groove by said depth.

2. A road marking tape as defined in claim 1, wherein said upper marking tape port with said retro-reflective elements and said protruding elements together form a marking tape, said compressible element being also a part of said marking tape.

3. A road marking tape as defined in claim 1, wherein said compressible material of said compressible element is formed so that it possesses a microcellular structure.

4. A road marking tape as defined in claim 1, wherein said compressible material of said compressible element is a terpolymer rubber.

5. A road marking tape as defined in claim 1, wherein said compressible material of said compressible element is a butyl rubber.

6. A road marking tape as defined in claim 1; and further comprising a layer of a bituminous meltable compound located in the groove and providing a bed for said compressible element.

7. A road marking tape capable of resisting the impact of snow plowing implements and similar apparatuses sliding above a road surface and insertable into a groove provided on the road surface, the road marking tape comprising a plurality of retroreflecting elements for ensuring the visibility of the tape in night time; a plurality of protruding elements acting as a rail and having a height at least equal to that of said retroreflective elements, said protruding elements being formed so as to resist the impact of snow plowing means of snow plowing implements and the like; and means for preventing damaging said retroflecting elements by the snow plowing means by allowing said protruding elements under the impact of the snow plowing means to sink into the groove by a depth at least equal to the height of said rails so that they are located at least at a road pavement level and therefore said retroreflective elements are not damaged by the snow plowing means, said damaging preventing means being formed as a compressible element located under said protruding elements and composed of a compressible material which is compressible in response to impact of said protruding elements by the snow plowing means so that under the action of the compression said compressible material of said compressible element is compressed and said compressible elements changes its thickness from its original thickness to such a thickness that said protruding elements sink into the groove by said depth, said compressible element including metallic elements composed of harmonic steel.

* * * * *